United States Patent [19]

Zimmern

[11] Patent Number: 4,900,239

[45] Date of Patent: Feb. 13, 1990

[54] METHOD AND A SCREW MACHINE FOR PROCESSING FLUID UNDER HIGH PRESSURES, WITH LIQUID INJECTION BETWEEN A SEALING PORTION AND A SUPPORT PORTION OF THE GATE-ROTOR

[76] Inventor: Bernard Zimmern, 6 New St., East Norwalk, Conn. 06855

[21] Appl. No.: 277,850

[22] Filed: Nov. 30, 1988

[30] Foreign Application Priority Data

Dec. 3, 1987 [FR] France ..... 87 16774

[51] Int. Cl.[4] ..... F01C 1/20; F01C 5/02; F01C 21/04

[52] U.S. Cl. ..... 418/1; 418/99; 418/153; 418/195

[58] Field of Search ..... 418/1, 99, 152, 153, 418/178, 195

[56] References Cited

U.S. PATENT DOCUMENTS 3,133,695 5/1964 Zimmern ..... 418/195
3,551,082 12/1970 Zimmern ..... 418/195
3,788,784 1/1974 Zimmern ..... 418/195

FOREIGN PATENT DOCUMENTS 1331998 6/1963 France .
1586832 1/1970 France .
2098655 3/1972 France .
2148677 3/1973 France .
2267462 11/1975 France .

*Primary Examiner*—John J. Vrablik
*Attorney, Agent, or Firm*—Young & Thompson

[57] ABSTRACT

A screw (1) rotates inside a bore (2a) of a casing and meshes with teeth (6) of a pinion or gate-rotor (7) comprised of a sealing portion (8) supported by a support portion (9). The sealing portion (8) has a limited angular play with respect to the support portion (9). This allows the sealing portion to undergo brief but abrupt accelerations or decelerations independently of the support portion (9). In order to allow frictionless angular displacement between the two portions liquid is injected between them at a moderate pressure when each tooth is out of engagement with the screw.

8 Claims, 2 Drawing Sheets

METHOD AND A SCREW MACHINE FOR PROCESSING FLUID UNDER HIGH PRESSURES, WITH LIQUID INJECTION BETWEEN A SEALING PORTION AND A SUPPORT PORTION OF THE GATE-ROTOR

BACKGROUND OF THE INVENTION

This invention relates to a method for processing fluids under high differential pressures with a positive displacement machine of the "single screw" type, i.e. in which a screw cooperates with one or a plurality of pinion-like gate-rotors.

This invention also relates to a positive displacement machine intended to work under high differential pressures.

U.S. Pat. No. 3 788 784 discloses single screw machines, which may be compressors, pumps, or expanders, having "floating gate-rotors", i.e. gate-rotors comprising a sealing portion made of plastics supported by a rigid metal support portion. The plastic sealing portion and the support portion are allowed to move angularly to a limited extent with respect to each other.

The instantaneous speed of the plastic sealing portion, having a very low inertia, can fluctuate as needed by the screw without incurring high forces, thus without incurring high contact pressures between the thread surfaces of the screw and the edges of the teeth of the gate-rotor. This limits wear.

This system has appeared to be essential to the life of the above mentioned machines.

It works very well provided that the discharge pressure remains within limits. For instance, such an air compressor operating with a discharge pressure up to 1 MPa or refrigeration compressor operating with a discharge pressure up to 3 MPa exhibits no wear of the gate-rotor after a significant time of operation, and this appears to be a result of the two-portions structure of the gate-rotor since, after such a time of operation, the plastic portion appears to have moved onto the support portion: the plastic is indeed polished where it has been in contact with the teeth of the support portion, and the polished area appears to be wider than the support teeth.

Nevertheless, when the differential pressure, (i.e. the pressure difference between intake and discharge) definitely exceeds the above mentioned values and especially when the liquid used to cool the machine—when used as a compressor—is not oil but e.g. water, which has poor lubricating properties, the pressure differential across the tooth is so high that it practically clamps the plastic sealing portion of the gate-rotor against the support portion thereof, and this can lead to wear of the gate-rotor.

OBJECT OF THE INVENTION

An object of the invention is to provide a method of supporting sealing teeth of a gate-rotor in order to avoid wear of said sealing teeth under high differential pressures.

Another object of the invention is to provide a positive displacement machine able to operate under high differential pressures without excessive wear of its gate-rotor.

SUMMARY OF THE INVENTION

This invention is directed to a method of supporting sealing teeth of a gate-rotor in a positive displacement machine having a screw rotatable inside a casing and provided with at least one thread groove successively and sealingly meshing with said sealing teeth of said gate-rotor, comprising the step of injecting liquid between the back face of said sealing teeth and a front face provided adjacent said back face on a support portion of said gate-rotor.

This invention is further directed to a positive displacement machine such as a compressor, a pump or an expander comprising:

a casing;

a screw provided with at least one thread groove and rotatably mounted in a bore of said casing;

at least one gate-rotor having teeth successively meshing with said thread groove of the screw while extending through a passageway provided through a wall of said bore, said gate-rotor comprising a sealing portion in sealing engagement with said at least one screw groove, a support portion having a front face for slidable abutment of a back face of said sealing portion, and angular displacement means allowing between the sealing portion and the support portion a limited angular displacement; and liquid injection means, for injecting liquid between said front face of the support portion and said back face of the sealing portion of said gate-rotor.

It has indeed been found that under high differential pressures, the slidability of the sealing portion against the support portion of the gate-rotor is recovered as soon as a film of liquid is provided between said two portions of the gate-rotor. Moreover, according to a further feature of the invention, said film can be created when the teeth are out of engagement with the screw. At that time, a low injection pressure is sufficient to inject some liquid between the two portions because there is no pressure urging the sealing portion against the support portion; and during each revolution of the gate-rotor, the time during which each tooth is subjected to the high pressure in a screw thread groove is so short that though liquid injection is interrupted at that time because of the high pressure pressing the two portions together, the previously injected liquid cannot be completely pressed away and therefore, there always remain a liquid film allowing for relative rotation between the two portions.

BRIEF DESCRIPTION OF THE DRAWINGS

This invention shall be better understood when reading the following description made by reference to the appended drawings, given as non limiting examples and in which.

DETAILED DESCRIPTION OF EMBODIMENTS

Figure 1:
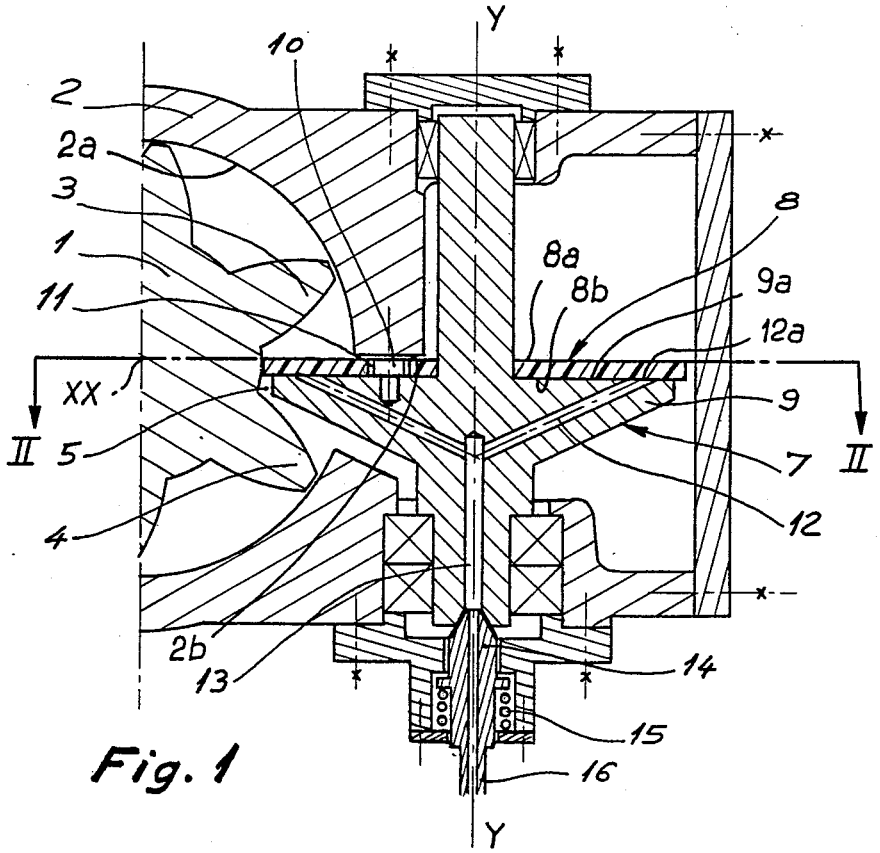
FIG. 1 is a half view of a positive displacement machine according to the invention, in cross section along the axis of a gate-rotor and normal to the axis of the screw.
Figure 2:
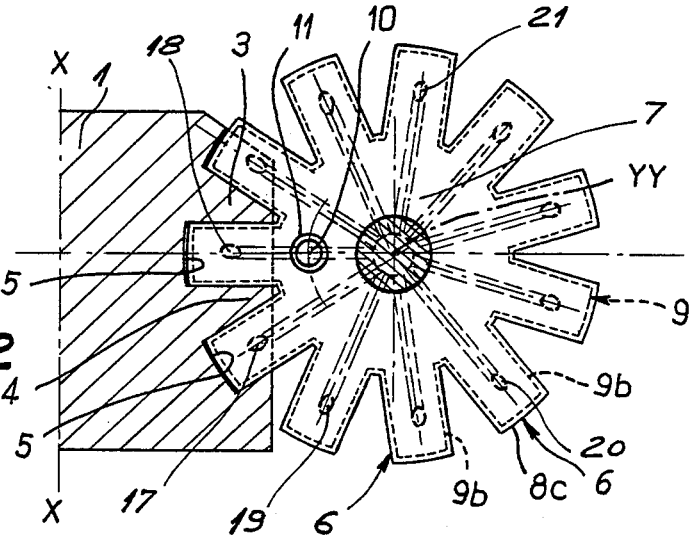
FIG. 2 is a schematic view of the screw and gate-rotor in section along line II—II of FIG. 1.

With reference to FIGS. 1 and 2, a screw 1 according for instance to U.S. Pat. No. 3 180 565, is mounted for rotation inside a bore 2*a* of a stationary casing 2 about an axis XX, and has threads such as 3 and 4 which define between them thread grooves such as 5 which mesh with teeth such as 6 of a gate-rotor 7. The screw 1 is driven in rotation by motor means in the case of a pump or a compressor and drives a load in the case of an expansion machine. The screw drives the gate-rotor 7 due to meshing between them. When meshing with the screw, the teeth 6 extend through a passageway 2b provided through the wall of bore 2a.

According to U.S. Pat. No. 3 788 784, gate-rotor 7 is made of two main portions. One of the two main portions is a sealing portion 8 provided with teeth 8c which, when meshing with a thread groove, such as 5, are in sealing contact with said grooves. During meshing, each tooth 8c separates the thread groove into two chambers which, due to the rotation of the screw and correlative rotation of the gate-rotor, vary in volume and selectively register with intake and discharge ports. The other main portion is a support portion 9 which does not contact the screw 1 but carries the axial load and pressure received by sealing portion 8. More specifically, portion 8 has a front face 8a is subjected to a pressure which at given instants is the highest pressure in the machine,—i.e. the discharge pressure in a compressor or a pump and the intake pressure in an expander—, and a back face 8b which is in surface contact with a front face 9a of the support portion 9. As shown in FIG. 2, the support portion 9 has teeth 9b which support the teeth 8c of sealing portion 8. In other words, each tooth 6 is made of a tooth 8c supported by a tooth 9b.

The two portions 8, 9 are mounted coaxially about an axis YY which in the example is normal to axis XX, but spaced apart therefrom. Portions 8, 9 are moreover connected together, for simultaneous rotation about axis YY, by means allowing between them a slight limited angular relative displacement about axis YY. Said means may be a pin 10 attached to support portion 9 and moving inside a hole 11 made in portion 8. The faces 8b and 9a are plane surfaces in the example as shown, and are in any case geometrically able to slide against each other.

Usually, sealing portion 8 is made of plastic and support 9 is made of cast iron or steel; however, according to the case, other materials can be used. The aim is that portion 8 have an inertia as small as possible so as to accelerate or decelerate under low efforts, whereas the support portion 9 continues to rotate at a substantially constant speed. This helps to reduce acceleration or deceleration efforts on the edges of the teeth 8c cooperating with the threads, and to eliminate wear.

This has proven to be very effective in air compressors, gas compressors or refrigeration compressors where discharge pressures do not exceed 3 to 4 MPa but is apparently inappropriate for pressures 5 to 10 times higher, such as 30 to 40 MPa. In such a case, the pressure acting on surface 8a and pushing the teeth 8c of the sealing portion 8 against the teeth 9b of the support portion 9 is so high that, even with plastic having good friction properties, the forces needed to move portions 8 and 9 angularly with respect to eachother are too high. A first solution to this problem is shown in FIG. 1.

The support portion 9 is provided with an axial main duct 13 which is fed with liquid by a stationary injector 14 urged by a spring 15 against a free end of the gate-rotor shaft integral with support portion 9. In each tooth 9b of support portion 9, there is provided an individual duct 12 extending between main duct 13 and an hole 12a provided through front face 9a in the vicinity of the tip of the tooth 9b, adjacent said back face 8b of sealing portion 8.

The injector 14 communicates with a pipe 16 feeding liquid taken e.g. from a liquid tank under pressure which is generally associated with such machines whether pumps or compressors and which is at machine high pressure, for instance discharge pressure in the case of a compressor.

But pipe 16 could also be fed by auxiliary means, such as a pump.

Such pressure is not high enough to overcome the pressure of the high pressure gas or liquid processed by the machine when holes 12a are in positions such as 17 or 18, in FIG. 2, i.e. when the teeth 6 are meshing with the screw and retain high pressure fluid in a thread groove 5. However, when the teeth are out of engagement with the screw, no pressure applies the faces 8b and 9a against eachother and liquid, even under a relatively low pressure, can flow by holes 12a when they are in positions such as 19, 20 or 21 in FIG. 2.

The plastic rigidity is indeed not high enough to close the holes 12a. Thus, when a tooth comes again into engagement with the screw and reaches positions such as 17 or 18, some liquid is trapped between the tooth 8c of portion 8 and the tooth 9b of portion 9; as time of passage at high pressure is extremely short (those machines having screws usually rotating at 1 000 to 10 000 rpm or more), whatever the pressure, the liquid has not enough time to be entirely removed of the space between the two portions and can act as a fluid bearing between them, thereby allowing relative displacement under a small torque, and wear on the edges of teeth 8c is eliminated.

Figure 3:
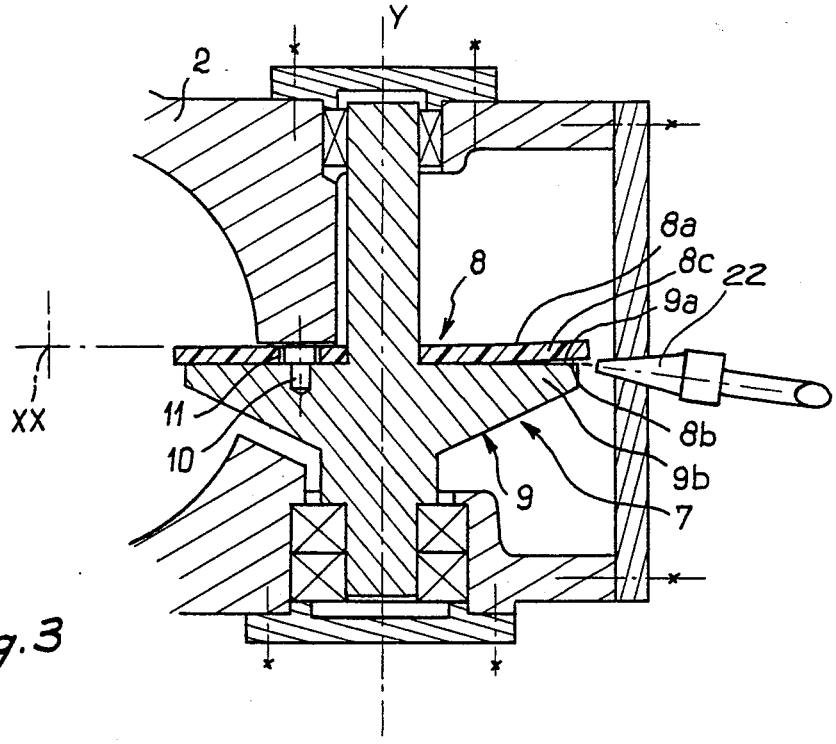
FIG. 3 is a view similar to FIG. 1 but concerning a second embodiment of the invention, the screw being not shown.
Figure 4:
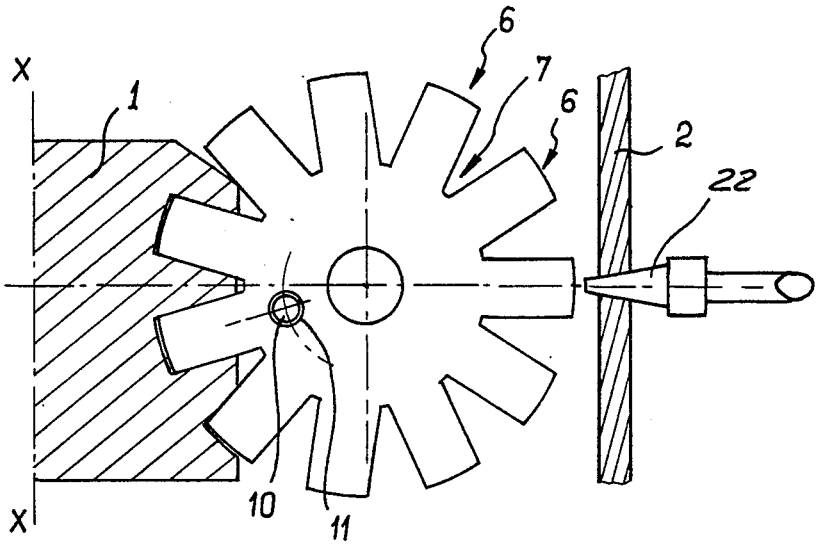
FIG. 4 is a view similar to FIG. 2 but concerning the embodiment of FIG. 3.

In an alternative embodiment of the invention shown in FIGS. 3 and 4, an injector 22 which is angularly positioned about axis YY so as to face the successive gate-rotor teeth when they are out of engagement with the screw, sends a jet of liquid between the two portions 8c, 9b of each tooth travelling in front of said injector. More specifically, the injector 22 is so oriented that the jet extends radially inwardly along an ideal extension of faces 8b, 9a.

Penetration of the liquid between both portions 8, 9 can be enhanced by having the plastic teeth 8c warping a little with respect to the support teeth 9b, as shown in FIG. 3; this creates a wedge-like gap where liquid can be injected.

Such warping which can without problem reach 0,2 or 0,3 mm on a gate-rotor having about 140 mm diameter has proved to be harmless to the life or sealing characteristics of the machine.

Indeed as soon as each tooth engages the screw, the plastic tooth is bent back into position against the support portion by the shape of the casing and by the pressure.

The above described warping is achieved by giving to the unloaded teeth 8c, during manufacturing, a slightly arcuate shape as seen in FIG. 3.

It can be noted that this invention has been described in the case of flat gate-rotors but it could be used without modification with a conical or a cylindrical gate-rotor as described in U.S. Pat. No. 3 551 082. It has also been shown with the angular connection between the two portions made by a pin such as 10 but other means can be used to achieve the same purpose without changing the nature of the invention.

I claim:

1. A method of supporting sealing teeth of a gate-rotor in a positive displacement machine having a screw rotatable inside a casing and provided with at least one thread groove successively and sealingly meshing with said sealing teeth of said gate-rotor, comprising the step of injecting liquid between a back face of said sealing teeth and a front face provided adjacent said back face on a support portion of said gate rotor.

2. A method according to claim 1, wherein said liquid is injected adjacent the back face of each tooth when said tooth is out of engagement with said screw.

3. A method according to claim 1, wherein said liquid is injected by forming a jet of liquid towards the gate-rotor substantially in an ideal extension of said front face and said back face.

4. A method according to claim 1, wherein said liquid is injected by forming a jet of liquid towards a wedge-like gap between said front-face and said back-face.

5. A positive displacement machine such as a compressor, a pump or an expander comprising:

a casing;

a screw provided with at least one thread groove and rotatably mounted in a bore of said casing;

at least one gate-rotor having teeth successively meshing with said thread groove of the screw while extending through a passageway provided through a wall of said bore, said gate-rotor comprising a sealing portion in sealing engagement with said at least one screw groove, a support portion having a front face for slidable abutment of a back face of said sealing portion, and angular displacement means allowing between the sealing portion and the support portion a limited angular displacement; and liquid injection means, for injecting liquid between said front face of the support portion and said back face of the sealing portion of said gate rotor.

6. A positive displacement machine according to claim 5 wherein said liquid injection means comprise duct means through said support portion and through a gate-rotor-shaft connected to said support portion, said duct means comprising at least one hole made in each tooth through said front face of the support portion adjacent the back face of the sealing portion.

7. A positive displacement machine according to claim 5, wherein said liquid injection means comprise at least one nozzle located near said gate-rotor in front of an area where the gate-rotor is out of engagement with the screw.

8. A positive displacement machine according to claim 7, wherein a gap is provided between the front face of the support portion and the back face of the sealing portion in said area.

* * * * *